United States Patent [19]

Bares et al.

[11] Patent Number: 5,023,625

[45] Date of Patent: Jun. 11, 1991

[54] INK FLOW CONTROL SYSTEM AND METHOD FOR AN INK JET PRINTER

[75] Inventors: Steven J. Bares; Marzio A. Leban, both of Corvallis, Oreg.

[73] Assignee: Hewlett-Packard Company, Palo Alto, Calif.

[21] Appl. No.: 464,706

[22] Filed: Jan. 12, 1990

Related U.S. Application Data

[63] Continuation of Ser. No. 230,644, Aug. 10, 1988, abandoned.

[51] Int. Cl.[5] ..... B41J 2/05; B41J 2/175

[52] U.S. Cl. ..... 346/1.1; 346/140 R

[58] Field of Search ..... 346/1.1, 140

[56] References Cited

U.S. PATENT DOCUMENTS

| | | | |
|---|---|---|---|
| 4,024,544 | 5/1977 | Vernon | 346/1.1 |
| 4,045,801 | 8/1977 | Iwasaki | 346/140 |
| 4,112,433 | 9/1987 | Vernon | 346/140 X |
| 4,291,316 | 9/1981 | Kakeno | 346/140 |
| 4,296,421 | 10/1981 | Hara | 346/140 |
| 4,424,520 | 1/1984 | Matsuda | 346/140 |
| 4,563,689 | 1/1986 | Murakami | 346/140 |
| 4,672,398 | 6/1987 | Kuwabara | 346/140 |

FOREIGN PATENT DOCUMENTS

| | | |
|---|---|---|
| 58-42466 | 3/1983 | Japan . |
| 212158 | 9/1987 | Japan . |

*Primary Examiner*—Joseph W. Hartary

[57] ABSTRACT

A piezoelectric pump or equivalent transducer is mounted on or within an ink jet printhead and is used to modulate the frequency or amplitude, or both, of oscillations of a liquid meniscus at a liquid ejection orifice of a nozzle plate. The liquid meniscus at the orifice has a natural resonant frequency and amplitude with respect to its equilibrium position, and the above modulation is performed in a controlled timed relation with respect to the phase of the natural oscillations of the meniscus at the liquid ejection orifice.

8 Claims, 6 Drawing Sheets

MENISCUS OSCILLATIONS

NATURAL MENISCUS OSCILLATIONS

INDUCED MENISCUS OSCILLATION

INDUCED MENISCUS OSCILLATION

INDUCED MENISCUS OSCILLATION

INK FLOW CONTROL SYSTEM AND METHOD FOR AN INK JET PRINTER

CROSS REFERENCE TO RELATED APPLICATION

This application is a continuation of application Ser. No. 230,644, filed 08/10/88, now abandoned.

TECHNICAL FIELD

This invention relates generally to ink jet printing systems and more particularly to such systems employing auxiliary ink pumping means for improving operational performance. These systems are operative to maintain a positive pressure within an ink cavity and ink channel of an ink jet pen for extending its maximum operating frequency.

BACKGROUND ART AND RELATED APPLICATION

In certain types of ink jet printing systems, such as thermal ink jet (TIJ) printers, the maximum achievable operating frequency, $F_{max}$, is inherently limited by: 1) the inability of the natural capillary action in the ink feed apparatus to adequately supply ink to the ink reservoir chamber (the ink cavity) of the printhead and 2) by oscillations of the ink meniscus at the orifice plate of the printhead which persist for some time, To, after drop ejection has occurred. One approach to extending $F_{max}$ as well as providing other operational improvements in thermal ink jet printheads is disclosed and claimed in copending Marzio A. Leban et al application Ser. No. 120,300 entitled "Integral Thin Film Injection System For Thermal Ink Jet Heads and Method of Operation", filed Nov. 13, 1987, now abandoned assigned to the present assignee and incorporated herein by reference.

Thermal ink jet printers having these operational characteristics are now generally well known in the art and are described, for example, in the *Hewlett-Packard Journal,* Volume 38, No. 5, May 1985, incorporated herein by reference. These printers employ printhead devices having resistive heater elements (resistors) which are normally aligned with corresponding ink ejection orifices in an adjacent orifice plate and are operative to receive electrical drive pulses from an external source. These pulses rapidly heat the heater resistors and thereby cause ink in an adjacent ink reservoir to vaporize and be forced out of the orifice plate during an ink jet printing operation. Thus, as the operating frequency of the printhead is extended out beyond a certain limit, there is a tendency for the natural capillary action of the ink feed system of the TIJ printer to inadequately supply the required volume of ink to the ink reservoirs associated with the heater resistors, the adjacent ink cavity and ink channel feeding the cavity.

This "ink starvation effect" becomes even more pronounced as the viscosity of the ink is increased. In many applications it is desirable to increase the ink viscosity in order to achieve an improved print quality on a variety of paper types and particularly plain paper. In addition to the above limitations imposed by this ink starvation effect, natural meniscus oscillations of the ink at the orifice further place a limitation on $F_{max}$ and persist for some time, To, immediately after a drop is ejected. During this time, To, further drop ejection is greatly restricted.

DISCLOSURE OF INVENTION

Accordingly, it is an object of this invention to overcome the above inability of the natural ink feed capillary action to adequately supply ink to the ink jet printhead during high frequency operation and thereby extend $F_{max}$ beyond its present limits.

Another object is to provide a new and improved printhead of the type described which is operative to generate meniscus oscillations of the ink at the orifice of a controlled frequency, Fm, and a controlled amplitude, Im. This action allows firing of ink drops of varying volume from the same orifice by timing the drop firing with meniscus height. Small drops are ejected when firing occurs at low meniscus levels, and large drops are ejected when firing occurs at high meniscus levels.

Another object is to extend the upper limit of the usable ink viscosity. This is accomplished by employing the pumping action of a piezoelectric system to produce a positive pressure over and above the natural capillary force within the ink capillary cavity and ink capillary channel of the ink jet printhead.

To achieve the above objects and attendant advantages of this invention, we have discovered and developed a new and improved ink feed system and method of operation for an ink jet printhead wherein the amplitude and frequency of oscillations of the meniscus at a fluid ejection orifice are controlled by ejecting fluid through an orifice and at a natural resonant frequency and amplitude with respect to an equilibrium position. The frequency or amplitude or both of the fluid meniscus at the orifice are modulated in a controlled phase relation with respect to the phase position of the oscillations of the meniscus above or below the equilibrium position.

In a preferred embodiment of the invention, a resistive heater element is aligned with respect to an orifice plate, and an ink flow path supplies ink into a chamber or reservoir between the resistive heater element and the orifice plate. This improved system includes, among other things: 1) a piezoelectric system which is mounted internal to the ink cavity of an ink jet printhead; 2) an external piezoelectric system which is mounted directly on the orifice plate of an ink jet printhead; 3) dual independent piezoelectric systems which are both mounted internal to the ink cavity of the printhead; and 4) dual piezoelectric systems with one being internal to the ink cavity of the printhead and the other being external and mounted directly on the orifice plate of the printhead. The above described ink feed systems may be used to: 1) produce oscillations of controlled frequency, Fm, and controlled amplitude, Im, of the ink meniscus at the ink ejection orifice and produce the ejection of ink drops from a single orifice with varying and controlled volumes; 2) extend the maximum frequency of operation, $F_{max}$, of the ink jet printhead; and 3) extend the viscosity range of inks which may be used.

The above brief summary of invention will become better understood and appreciated from the following description of the accompanying drawing.

DETAILED DESCRIPTION

Figure 1:
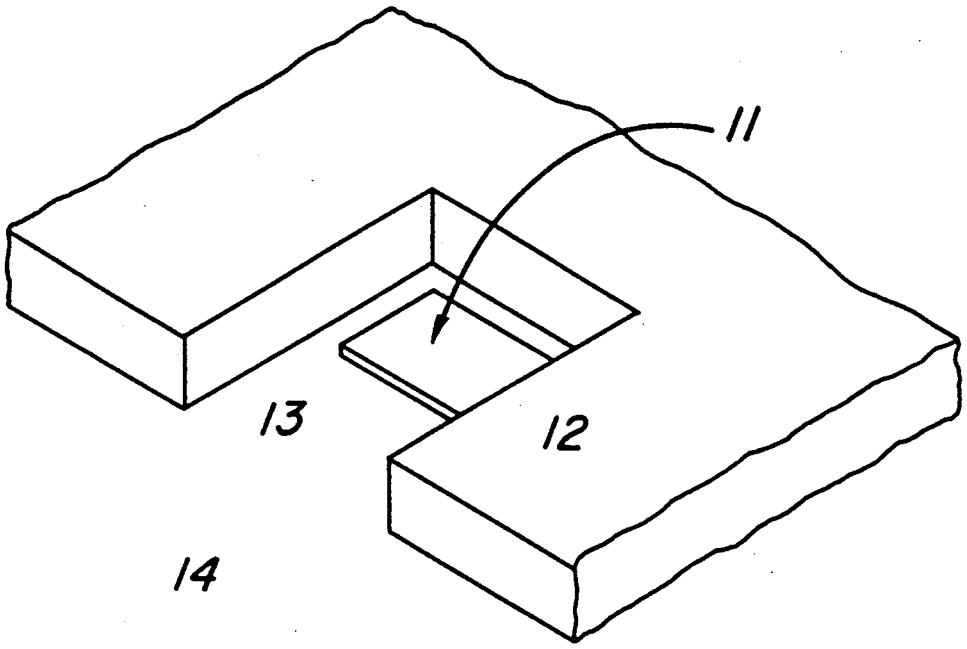
Fig. 1 PRIOR ART
FIG. 1 is an abbreviated perspective view showing a typical mounting arrangement of a heater resistor within an ink feed channel.

Referring now to FIG. 1, there is shown a perspective view of a single heater element (resistor) 11 surrounded by a barrier material 12 forming an ink channel 13 immediately adjacent to the resistor 11. The barrier material 12 also forms an ink cavity region 14 exterior to the ink channel 13. This type of three sided barrier layer construction is generally well known in the art and is disclosed for example in Howard H. Tabu et al U.S. Pat. Nos. 4,794,410 and 4,794,411 assigned to the present assignee and incorporated herein by reference.

Figure 2:
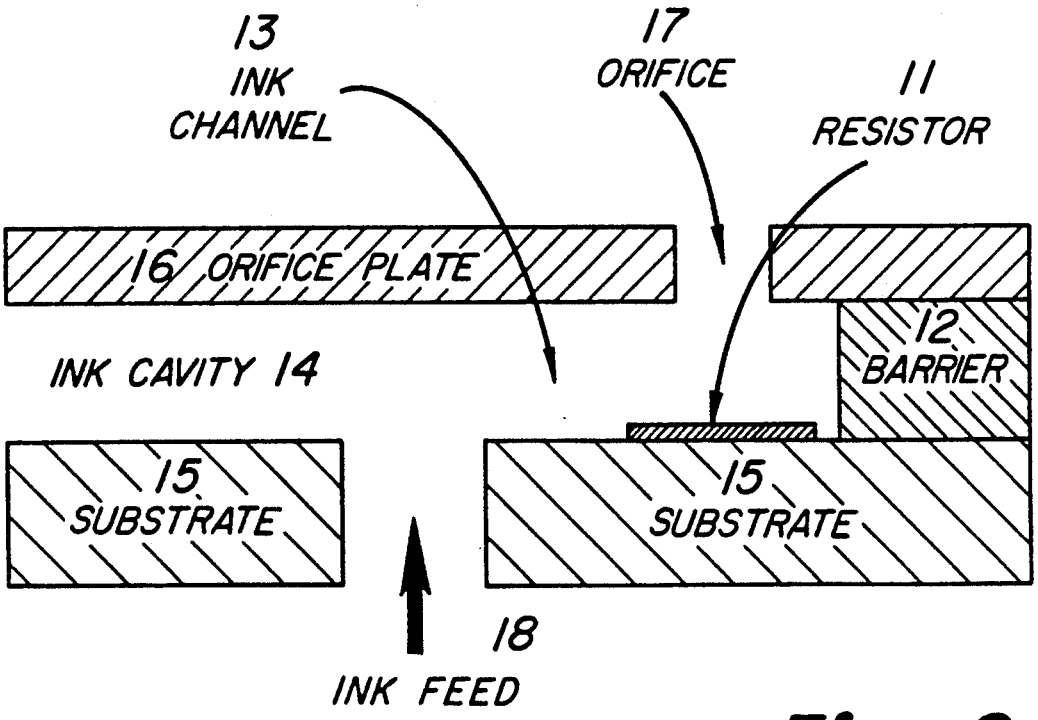
Fig. 2 PRIOR ART
FIG. 2 is an abbreviated cross section view showing the position of the heater resistor with respect to the main ink feed channel, the ink cavity and the orifice plate of the thermal ink jet printhead.

FIG. 2 is a cross section view which would be taken through the center of the resistor in FIG. 1 when the printhead structure therein, including the orifice plate, is completed. FIG. 2 further illustrates that the ink cavity 14 is formed between an underlying substrate 15 and an outer orifice plate 16. An orifice 17 is positioned immediately above the resistor 11, and ink from an ink feed system 18 is drawn into the ink cavity 14 and into the ink channel 13 regions by a capillary force.

Figure 3A:
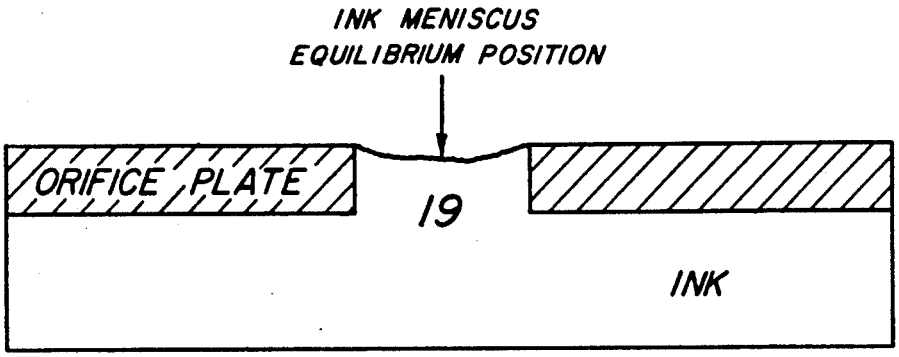
Fig. 3A PRIOR ART
FIGS. 3A-3C show, in abbreviated cross-section, three different meniscus positions during its oscillation at an orifice opening.
Figure 3B:
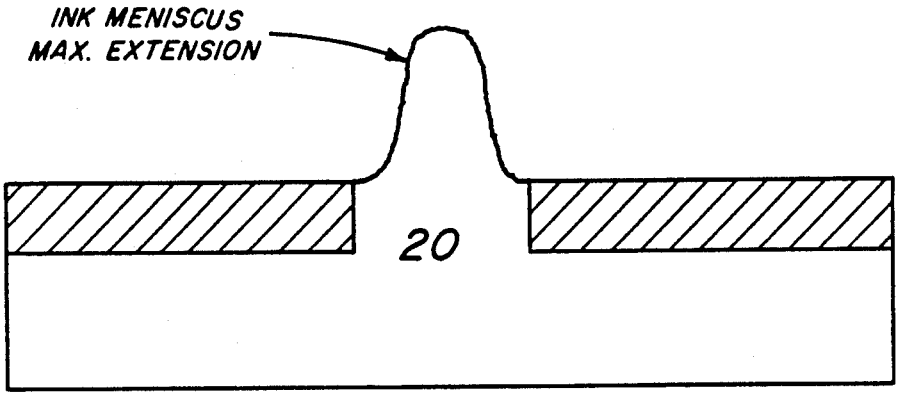
Fig. 3B PRIOR ART
Figure 3C:
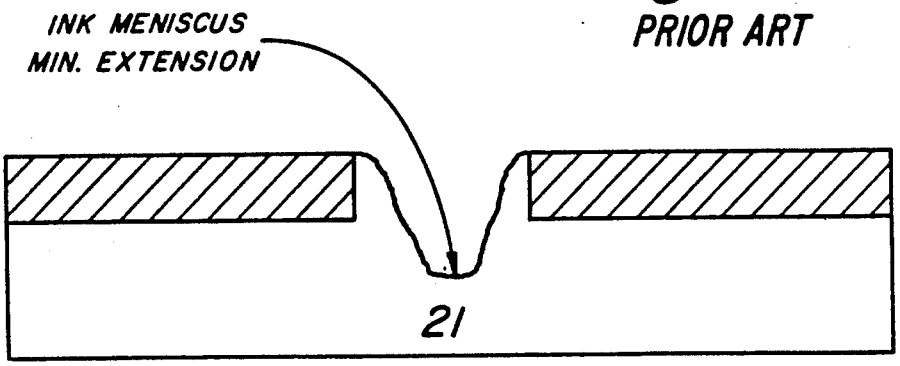
Fig. 3C PRIOR ART
Figure 4A:
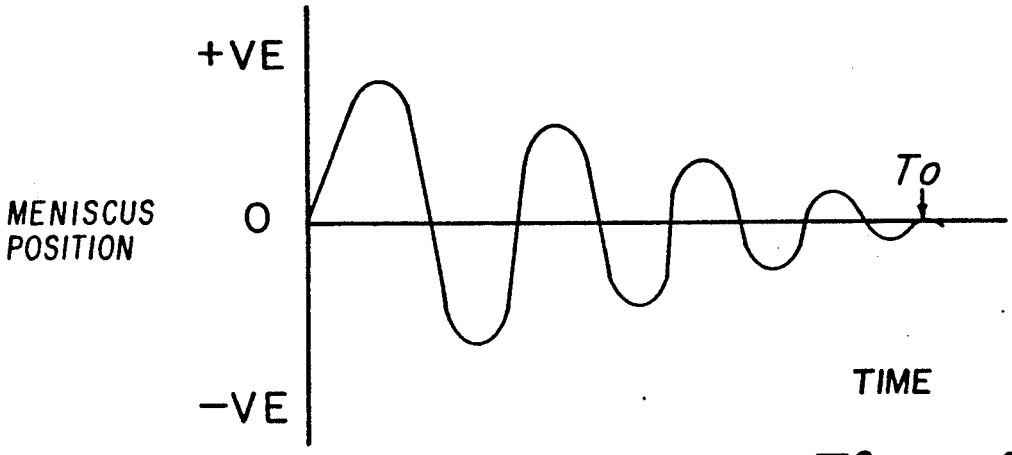
Fig. 4A PRIOR ART
FIGS. 4A-4B compare the natural meniscus oscillation with the induced meniscus oscillation provided in accordance with the present invention.

As the resistor 11 is fired by a suitable pulse applied thereto, a drop of ink is ejected from the orifice 17. An ink jet printhead operating in this manner is considered to be operating in the "equilibrium mode". Immediately after drop ejection in the equilibrium mode, the meniscus of the ink at the orifice 17 will oscillate from the equilibrium position 19 as indicated in FIG. 3A and achieves a maximum extension 20 and a minimum extension 21 as indicated in FIGS. 3B to 3C. These "natural oscillations" continue for a length of time, labeled the "dead time", To, with a decaying amplitude as shown in FIG. 4A. During this time, ejection of an additional drop of ink is not permitted.

Figure 5:
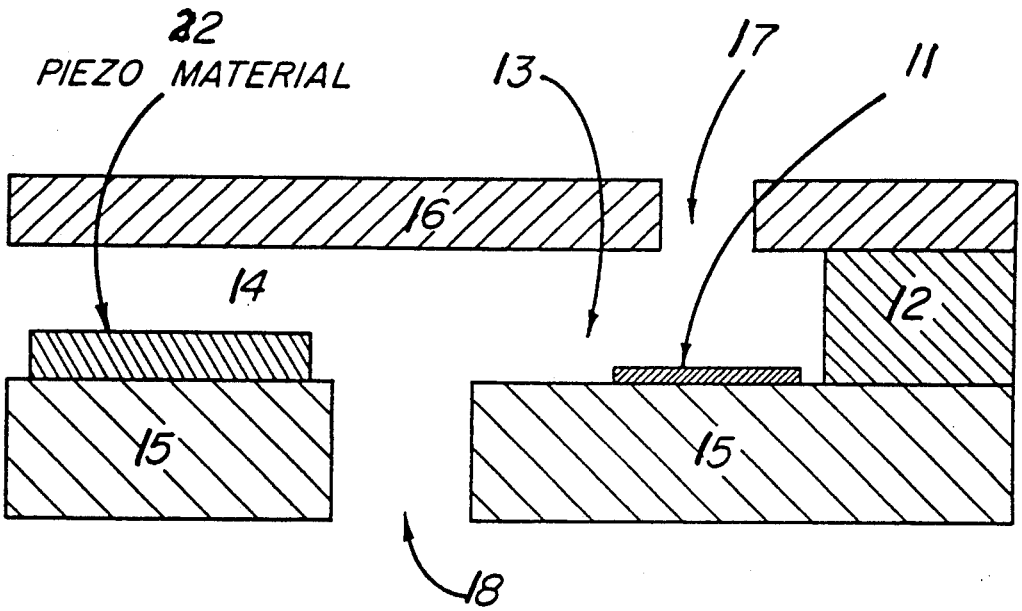
FIG. 5 is an abbreviated cross section view of an ink jet printhead which shows the piezoelectric pump material mounted within the ink cavity of the printhead.
Figure 6:
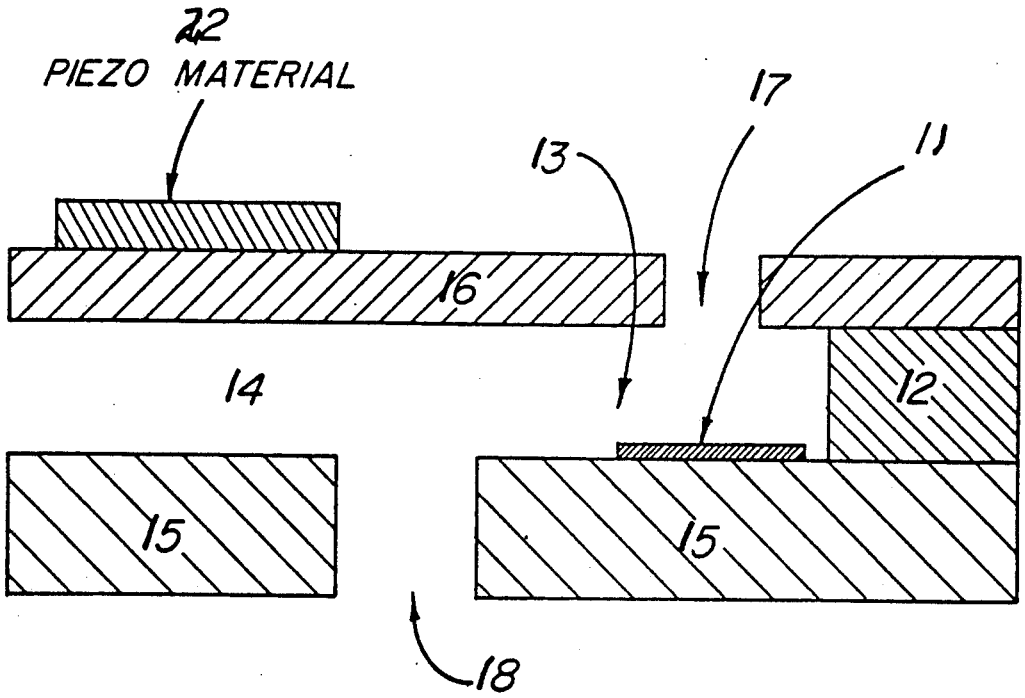
FIG. 6 is an abbreviated cross section view of an ink jet printhead which shows the piezoelectric pump material mounted on the orifice plate of the printhead.

In accordance with the present invention, a piezoelectric material 22 such as quartz or barium titanate crystals or a kynar piezoelectric film is introduced into the ink cavity 14 as shown in FIG. 5, or is mounted externally on the outer surface of the orifice plate 16 as shown in FIG. 6. The material 22 is connected in such a manner that it can be energized with a controlled electrical signal, and this signal induces oscillations, of controlled frequency and magnitude, within the material 22. This action in turn produces a positive ink pressure within the ink cavity 14 and the ink channel 13 and thereby behaves as an ink pump. Both internally and externally mounted piezoelectric systems function in an equivalent manner.

There are various available piezoelectric driving circuits suitable for providing the piezoelectric drive signals described herein, and the choice of circuit design of these drivers is considered well within the skill of the art. Therefore, a detailed description of specific driver circuit design has been omitted for sake of brevity. However, piezoelectric driver circuits have been described in many U.S. Patents, such as U.S. Pat. Nos. 4,714,935, 4,717,927, 4,630,072, 4,498,089 and 4,521,786. Piezoelectric driver circuits have also been enclosed in the following four textbook references, and these four textbook references as well as the above patents are incorporated herein by reference:

1. *Precision Frequency Control;* E. A. Gerber, Ed. Academic Press, 1985.
2. *Acoustic Waves: Devices, Imaging and Analog Signal Devices;* Gordon Kino, Prentice-Hall, 1987.
3. *Standard Methods for the Measurement of Equivalent Circuits;* American National Standards, Electronic Industries Association, 1985.
4. *PVF2 - Models, Measurements, Device Ideas,* John Linvill, Stanford Technical Report number 4834-3, Stanford University, 1978.

Figure 4B:
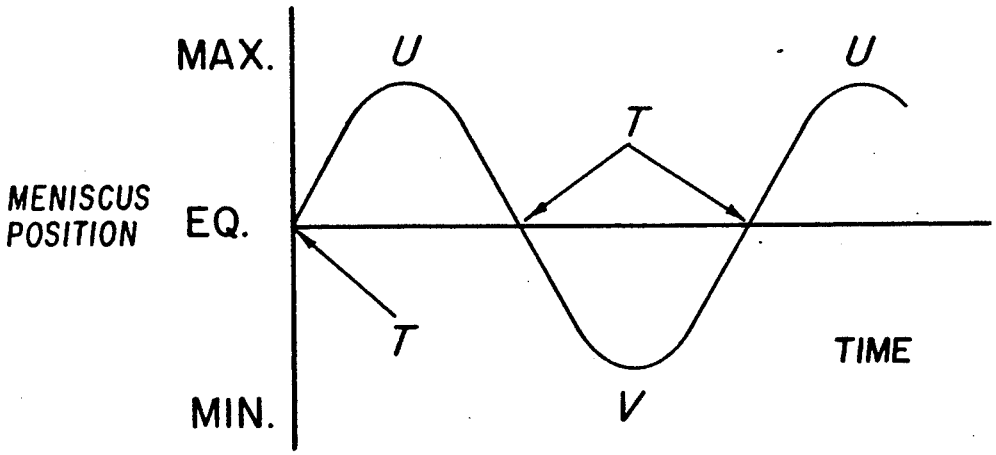

The oscillations of the piezoelectric material 22 produce a constant, symmetric and continuous oscillation of the ink meniscus as shown in FIG. 4B. These continuous, induced, symmetric and controlled meniscus oscillations of frequency, Fm, and amplitude, Im, in FIG. 4B are superimposed on the "natural oscillations" in FIG. 4A. The net result of this superposition of these two kinds of meniscus oscillations is a virtual "swamping out" of the natural meniscus oscillations in FIG. 4A, and the virtual elimination of the "dead time", To, which is responsible for limiting the maximum operating frequency, $F_{max}$, of the ink jet printhead.

The timing of the firing of resistor 11 with respect to the meniscus amplitude, Im, of the induced meniscus oscillations is crucial. If the resistor 11 is fired at the equilibrium position, or points (T) in FIG. 4B, the ink jet printhead is operating in the "equilibrium mode" and medium volume ink drops, Veq, are ejected. These ejected ink drops are of a volume equal to the case where the piezoelectric material is not pulsed. The maximum achievable operating frequency, $F_{max}$, of the ink jet printhead operating in the "equilibrium mode" is limited only by the frequency of induced meniscus oscillations, Fm. If the resistor 11 is fired at the maximum meniscus extension position, namely at points (U) in FIG. 4B, then the ink jet printhead is operating in the "rich mode" and maximum volume ink drops, $V_{max}$, are ejected. If the resistor 11 is fired at the minimum meniscus extension position, which is point (V) in FIG. 4B, then the ink jet printhead is operating in the "lean mode" and minimum volume ink drops, Vmin, are ejected. Firing the resistor 11 at different points between the rich and lean modes will cause ink drops to be ejected in varying and controlled volumes.

Figure 7:
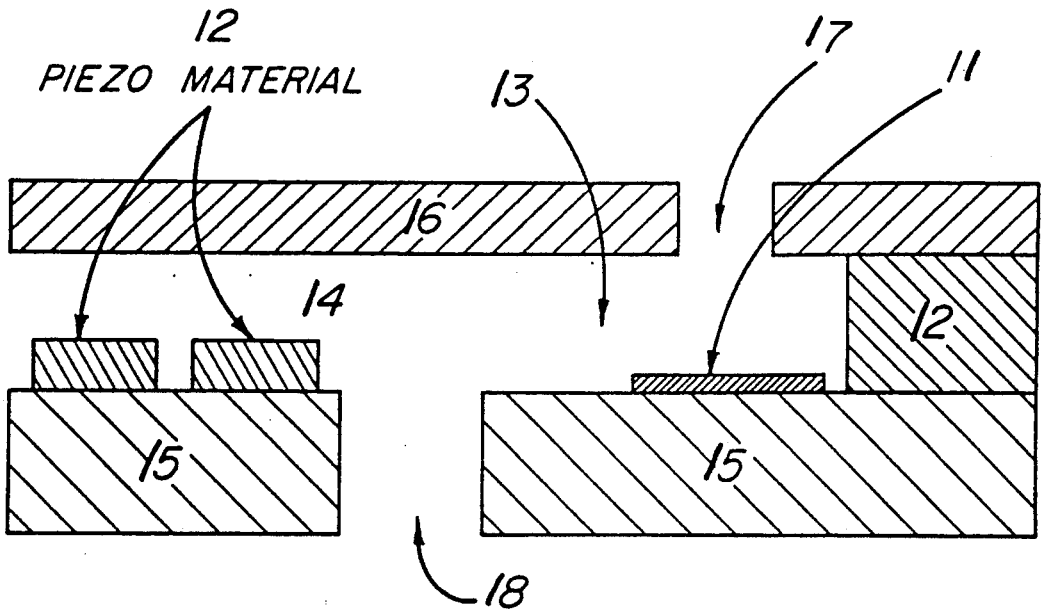
FIG. 7 is an abbreviated cross section view of an ink jet printhead which shows two (2) separate piezoelectric pump transducers mounted within the ink cavity of the printhead.

The range of ejected ink drop volume may be extended by employing dual independently controlled piezoelectric systems within an ink jet printhead. FIG. 7 illustrates such a system where both independently controlled piezoelectric drivers 22 are incorporated within the ink cavity 14.

Figure 8:
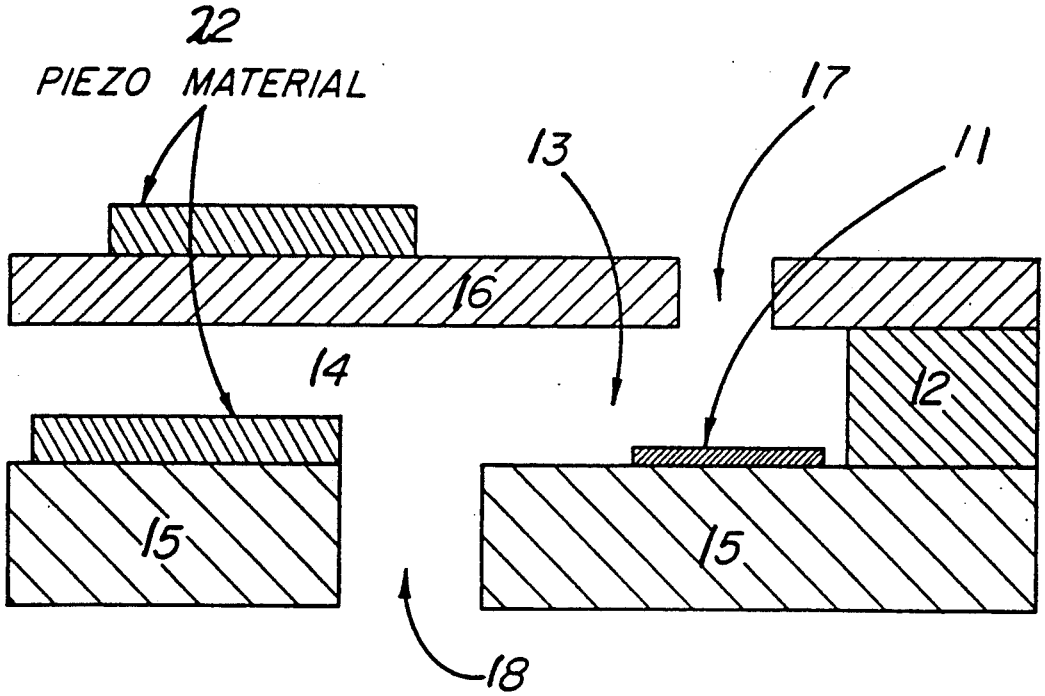
FIG. 8 is an abbreviated cross section view of an ink jet printhead which shows the piezoelectric pumps mounted on both the orifice plate outside the ink cavity and within the ink cavity of the printhead.

FIG. 8 illustrates another system where the piezoelectric drivers 22 are incorporated both inside and outside the ink cavity 14, with the outside driver mounted on the orifice plate 16. The method of operation of both these systems in FIGS. 7 and 8 is the same.

Each independently driven piezoelectric driver 22 may be energized with a controlled signal and caused to oscillate which in turn induces a symmetric meniscus oscillation as described above. If both piezoelectric drivers within an ink jet printhead are caused to oscillate in phase with each other and with equivalent amplitudes, then the induced meniscus oscillation remains symmetric as described above with reference to FIG. 4B.

Within the ink jet printhead, both piezoelectric drivers 22 may be caused to: 1) oscillate out of phase with each other at the same frequency and amplitude; or 2) oscillate out of phase with each other at the same amplitude and with a different frequency. The combination of frequency, amplitude and phase shift may be selected to induce a meniscus oscillation which is asymmetric as shown in FIGS. 9A and 9B.

Figure 9A:
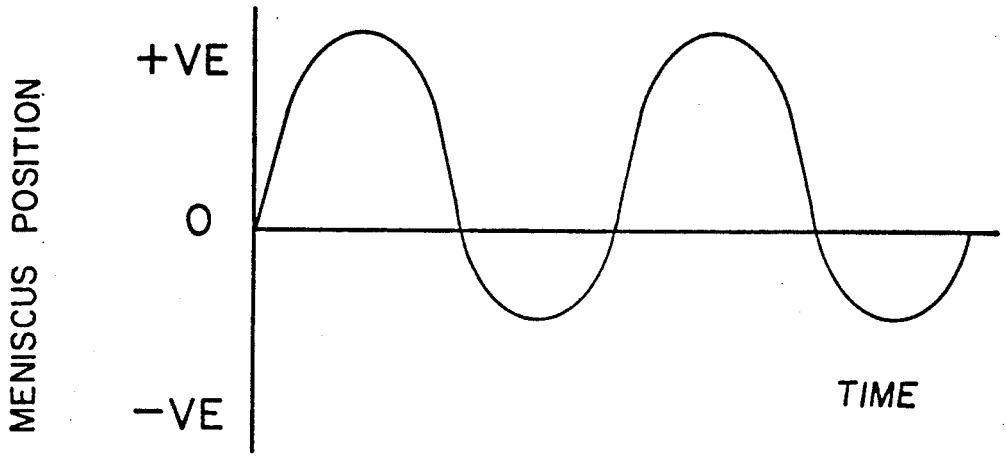
FIGS. 9A-9B show the shifting of the induced meniscus oscillation about the meniscus equilibrium position by an amount controlled by the timing of pressure pulses generated by the piezoelectric pump or pumps of the ink jet printhead.

If the induced asymmetric meniscus oscillation is skewed to the positive as shown in FIG. 9A, the maximum volume ink drop, Vmax, ejected may be further extended from the symmetric case due to the greater meniscus extension in the asymmetric case. The limiting situation is attained when the asymmetric positive meniscus extension is so great that actual drop ejection begins to occur. Large positive asymmetric meniscus extensions may be favored by suitable choice of ink viscosity and surface energy of the ink.

Figure 9B:
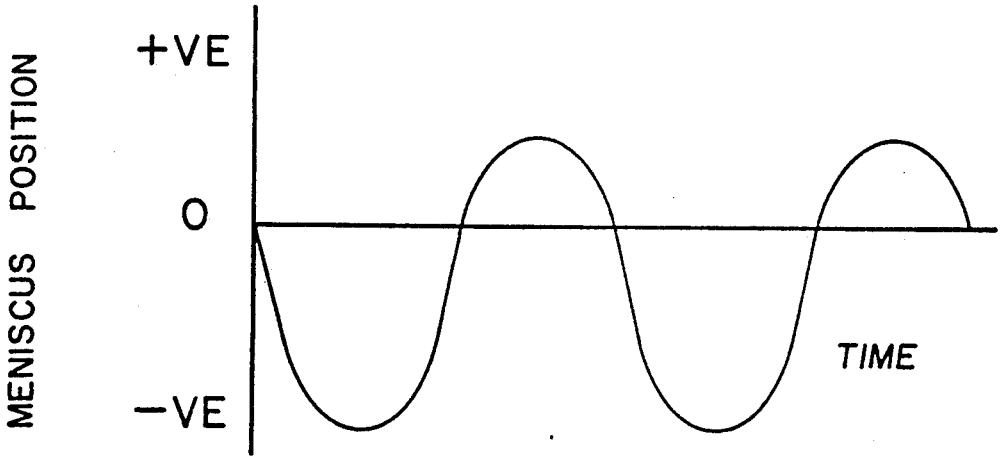

Alternatively, if the asymmetric meniscus oscillation is skewed to the negative as shown in FIG. 9B, the minimum volume ink drop, Vmin, ejected may be further extended from the symmetric case. The limiting situation is attained when the asymmetric negative meniscus extension is so great that the printhead will begin to aspirate air through an orifice opening in the orifice plate of the printhead. Air aspiration may be modified by suitable choice of ink viscosity and ink surface energy.

The pumping action of the added piezoelectric system described above enables the ink jet printhead to be used not only with current inks, with their low viscosities (< about 3 cps) and higher surface tensions (> about 55 dyne/cm), but also with inks having a lower surface tension and a higher viscosity. Generally, higher viscosity inks penetrate slower into the surface of paper such that the print quality on a variety of papers, and particularly on xerographic or bond papers, is improved. Printheads using higher viscosity inks therefore print more consistently on a wider set of plain papers. The ability to use both high viscosity and low surface tension inks yield faster drytimes on plain papers as well.

The ability to use higher viscosity inks with a lower surface tension has significant advantages over current technology. Standard ink technology, which employs soluble dyes in a usually aqueous based vehicle, could be expanded to use a much larger group of allowable solvents. For example, higher molecular weight glycols, ethers, ketones, and the like could be used in conjunction with water to obtain the desired vehicle properties. This expanded group of solvents allow dyes to be used in the new printhead described herein which are not currently acceptable because of solubility or reactivity with the ink vehicle. These additional dyes improve contrast, color, hue and print quality on the printed medium. Besides the improved print quality inherent in higher viscosity inks, other solvent and dye mixtures could yield improved waterfastness, reliability, smearfastness, lightfastness and archivability. Also, additional color dyes could be used, with a possible attendant improvement in color gamut and bleed characteristics.

The ability to lower the requirements of surface tension and raise the allowable limit on viscosity would enable the printhead to be used with "non standard" ink jet inks (e.g. non-aqueous, dye based). For example, pigment based, microemulsion or encapsulation inks could be used. These new colorant systems would offer higher waterfastness, improved smearfastness, better color gamut, better reliability and better lightfastness and bleed.

Various modifications may be made to the above described embodiments without departing from the scope of this invention. For example, the present invention is not strictly limited to the specific printhead cross-section geometries shown and may be practiced using various printhead geometries including the well known "side shooter", "face shooter' and "edge-shooter" constructions and the use of offsets between heater resistor center lines and orifice centers. Additionally, the geometries of the ink feed channel and the ink reservoir cavities may be modified in accordance with the design constraints applicable to a variety of thermal ink jet printhead applications, and may include various state of the art hydraulic tuning and crosstalk reduction features.

We claim:

1. A method for pumping ink to an opening in an inkjet printhead orifice plate to overcome the inability of the natural ink feed capillary action to adequately supply ink to the inkjet printhead and to extend the maximum operational frequency thereof while simultaneously controlling and varying the ink drop volume ejected from said orifice plate, which comprises the steps of:

a providing an ink flow path to an opening in said orifice plate, b pulsing a first transducer in or adjacent to said ink flow path and disposed on said printhead to provide a pumping action in a direction parallel to said ink flow path to enable said printhead to operate with inks having a lower surface tension and a higher viscosity or both and to control the oscillations of an ink meniscus at said opening in said orifice plate, and c pulsing a second transducer in said ink flow path so that the pulsing of said second transducer ejects ink drops of varying volume from said orifice opening by timing said drop ejection with the height of said meniscus at said orifice plate opening, whereby small drops are ejected when the firing of said second transducer occurs at low meniscus levels, and large drops are ejected when the firing of said second transducer occurs at high meniscus levels.

2. The method defined in claim 1 wherein the pulsing of said first transducer comprises firing a piezoelectric element in or adjacent said ink flow path for pumping ink toward said orifice opening and for modulating the oscillations of said meniscus at said orifice plate opening, and the pulsing of said second transducer comprises the firing of a resistive heater element within said ink flow path in a timed relationship with respect to oscillations of said meniscus for controlling the drop volume ejected from said orifice plate opening.

3. An inkjet printhead operable for providing a pumping action useful for producing a positive pressure over and above the natural capillary force within an ink capillary cavity and associated ink feed channel of said ink jet printhead and for extending the maximum operating frequency of ink ejection therefrom and for simultaneously varying the drop volume of ink ejected from said printhead, comprising:

a a substrate having an ink supply channel therein for receiving ink from a remote source, b an orifice plate mounted above said substrate and having an orifice opening therein for receiving ink from said ink supply channel, c a first transducer positioned adjacent said channel and being operative to flex in a direction perpendicular to said substrate and parallel with the flow of ink through said ink feed channel for pumping ink through said ink supply channel and overcoming the inability of the natural ink feed capillary action to adequately supply ink to said ink jet printhead, said first transducer also being operative to pump ink toward and said opening in said orifice plate and allowing said printhead to operate with inks having a lower surface tension and a higher viscosity or both, d a second transducer positioned adjacent said orifice opening for controlling the ejection and drop volume of ink through said orifice opening, whereby said first transducer is operative to simultaneously control the oscillations of an ink meniscus at said orifice opening and to pump ink thereto, and said second transducer is operative to generate a firing pulse at a chosen phase position of an oscillating ink meniscus at said orifice opening with respect to an ink meniscus equilibrium position at said opening to control the drop volume of ink ejected from said orifice opening.

4. The printhead defined in claim 3 wherein said first transducer is a piezoelectric element, and second transducer is a resistive heater element.

5. The printhead defined in claim 3 wherein said first transducer is a piezoelectric element disposed on said substrate on one side of said ink supply channel, and said second transducer is a resistive heater element disposed on said substrate on the other side of said ink supply channel and aligned with respect to said opening in said orifice plate.

6. The printhead defined in claim 5 which further includes a third transducer comprising a piezoelectric element disposed on said orifice plate, whereby both said first and third transducers are operative to provide pumping action for propelling ink towards said opening in said orifice plate and said resistive heater element is operative to control the drop volume of ink drops ejected from said opening in said orifice plate.

7. The printhead defined in claim 3 wherein said first transducer is a piezoelectric element disposed on said orifice plate.

8. The printhead defined in claim 7 wherein said second transducer is a resistive heater element disposed on said substrate and aligned with respect to said opening in said orifice plate.

* * * * *